United States Patent [19]

Knight et al.

[11] 4,083,077

[45] Apr. 11, 1978

[54] HAND TOOL FOR CLEANING FABRIC

[76] Inventors: Arlen M. Knight, 3943 Laguna Blanca; William Hachtmann, 4197 State St., both of Santa Barbara, Calif. 93110

[21] Appl. No.: 640,493

[22] Filed: Dec. 15, 1975

[51] Int. Cl.[2] ..... A47L 7/00

[52] U.S. Cl. ..... 15/321; 15/322; 15/422; 285/7; 285/276

[58] Field of Search ..... 15/321, 322, 353, 422; 285/7, 276

[56] References Cited

U.S. PATENT DOCUMENTS

| | | | |
|---|---|---|---|
| 1,929,345 | 10/1933 | Brown et al. | 15/322 X |
| 2,292,435 | 8/1942 | Crites | 15/322 X |
| 2,703,905 | 3/1955 | Faith-Ell | 15/422 X |
| 3,073,626 | 1/1963 | Gasparini | 285/7 |
| 3,239,244 | 3/1966 | Leinfelt | 285/276 X |
| 3,747,155 | 7/1973 | Koellisch | 15/322 |
| 3,919,729 | 11/1975 | Cannan | 15/321 X |

*Primary Examiner*—Christopher K. Moore
*Attorney, Agent, or Firm*—Ralph B. Pastoriza

[57] ABSTRACT

A hand tool is constructed for detachable connection to a fluid cleaning machine such as a steam cleaning unit. A hollow head has convexly rounded front and rear edges to promote smooth back and forth sliding motion over fabric. Forward and rearward regions of the head constitute a suction chamber and a spray chamber respectively. A fluid solution line is surrounded and protected by a flexible suction hose that is releasably coupled to a neck of the hand tool. A flow control interconnects the fluid solution line and a spray nozzle in the spray chamber. Baffles positioned across a lower opening of the suction chamber reduce wrinkling and ridging tendencies of the fabric as it is being cleaned.

2 Claims, 5 Drawing Figures

HAND TOOL FOR CLEANING FABRIC

BACKGROUND OF THE INVENTION

Briefly stated, this invention relates to cleaning equipment and more specifically to hand tools attachable to fluid cleaning machines.

An improved approach to cleaning fabric generally known as "fluid extraction" has become popular and widespread in recent years. Departing significantly from conventional procedures, the fluid extraction procedure has been developed to actually remove soil, dirt etc. from carpets, rugs, upholstery, drapes and related fabrics.

Various shampoo processes have been employed over the years in an attempt to remove soil from carpets and other fabrics, but the scrubbing brushes used in the shampoo processes are often too harsh on many fabrics and on the pile of standard carpets. The scrubbing action of the brushes drives dirt particles and detergent down into the pile of a carpet, for example, where it is temporarily concealed by the resultant matted down pile. Shampoo procedures are thus not satisfactory for many carpet and fabric cleaning jobs.

Whereas shampoo procedures superficially clean the surface of a carpet pile, a fluid extraction method removes soil and carries it away. All fluid extraction apparatus includes a working or cleaning head that moves over the underlying fabric to be cleaned. In the cleaning cycle, a continuous charge of pressurized fluid (usually wet steam with emulsifiers, detergents, deodorants, etc.) penetrates into the carpet pile or fabric to loosen and suspend embedded soil and immediately thereafter the soil is lifted and drawn entirely out of the carpet pile or fabric by a constantly applied and trailing suction force.

Smaller working heads, called hand tools, are used with fluid extraction machines for cleaning upholstery and drapery fabrics. Conventional hand tools have a rear spray chamber and a front suction chamber so the operator may clean fabric while grasping the hand tool and pulling it backwards. The operator or workman intermittently pulls the hand tool through a cleaning stroke and then must lift it back to an extended or reset position prior to sweeping the hand tool through another cleaning stroke.

These known hand tools have flat and relatively sharp edges that necessitate slow cleaning strokes in order to avoid bunching and/or catching on the fabric as the hand tool is pulled backwards.

Moreover, due to the vacuum force exerted through these known hand tools, fabric is often pulled into the bottom opening or mouth of the suction chamber and this action often causes wrinkling of the fabric while further slowing down the cleaning operation.

Another disadvantage with conventional hand tools is that the fluid solution line runs externally of the suction hose coupled to the hand tool. The necessary valves, controls, etc. interconnecting the fluid solution line and the hand tool spray chamber are exposed and are therefore prone to catching on some stationary object. This interferes with cleaning progress and may present a safety hazard. The externally exposed valves, controls, etc. generally make these conventional hand tools bulky, cumbersome and unsightly. With the fluid solution lines being exposed and externally positioned, there is an ever-present risk of rupture, leakage etc. with consequent harm to the operator and damage by spillage to property. In addition, the operator's sleeve may become caught on the externally positioned valves and related components.

The aim of this invention is to avoid the foregoing disadvantages and annoyances, primarily by way of a unique and greatly improved hand tool and also by a special coupling between the hand tool and a fluid cleaning machine.

SUMMARY OF THE INVENTION

This invention comprehends a hand tool associated with a fluid cleaning machine for cleaning carpets.

In its broader aspects the hand tool embodies a generally hollow head defining a spray chamber with a bottom opening and a suction chamber with a bottom opening positioned forwardly of the spray chamber.

A front wall of the head has a convexly rounded portion to facilitate forward movement by the hand tool over fabric and similarly a rear wall of the head has a convexly rounded portion to facilitate rearward movement by the hand tool over fabric.

A hollow neck is coupled to the head and arranged in communication with the suction chamber. A flow control interconnects a fluid solution line and a spray nozzle positioned in the spray chamber. As an operator pulls the hand tool rearwardly, suction may be applied to clean areas of the underlying fabric that have been previously sprayed.

Preferably the lower corners of the head are also rounded to facilitate angled or misaligned movement of the hand tool over fabric.

A special hold down means is connected to the head and positioned within the suction chamber bottom opening for reducing wrinkling and ridging tendencies by the fabric as the head is being moved over the fabric. Preferably the hold down means includes a plurality of elongated rods with their opposing ends connected to side walls of the head. The rods act as baffles.

In another embodiment of the invention, a second suction chamber is positioned rearwardly of the spray chamber. Separator walls isolate the spray chamber from the fore and aft suction chambers. By this arrangement suction may be continuously applied to sprayed areas of the underlying fabric as the hand tool is alternately pushed forwardly and pulled rearwardly.

An elongated flexible vacuum hose is releasably coupled to the neck for carrying away material drawn by suction force through the suction chamber. The fluid solution line is substantially co-extensive with and surrounded by the vacuum hose and one of its ends projects laterally through the neck and into connection with the flow control. The flow control is confined within a space entirely beneath the neck.

The hand tool is constructed for usage in connection with a conventional steam cleaning machine having a dispensing tank which holds the fluid solution and a recovery tank. A special swivel coupling interconnects the vacuum hose and the recovery tank for the purpose of facilitating maneuverability of the hand tool and hose by an operator.

A collar projects from the recovery tank and is formed internally with a step ring. The swivel coupling includes a sleeve having one end inserted within the vacuum hose and its other end formed with an annular groove positioned within the collar. The stop ring is positioned within the annular groove.

BRIEF DESCRIPTION OF THE DRAWINGS

The numerous benefits and unique aspects of the present invention will be fully understood when the following detailed description is studied in conjunction with the drawings in which.

DETAILED DESCRIPTION OF THE PREFERRED EMBODIMENT

Figure 1:
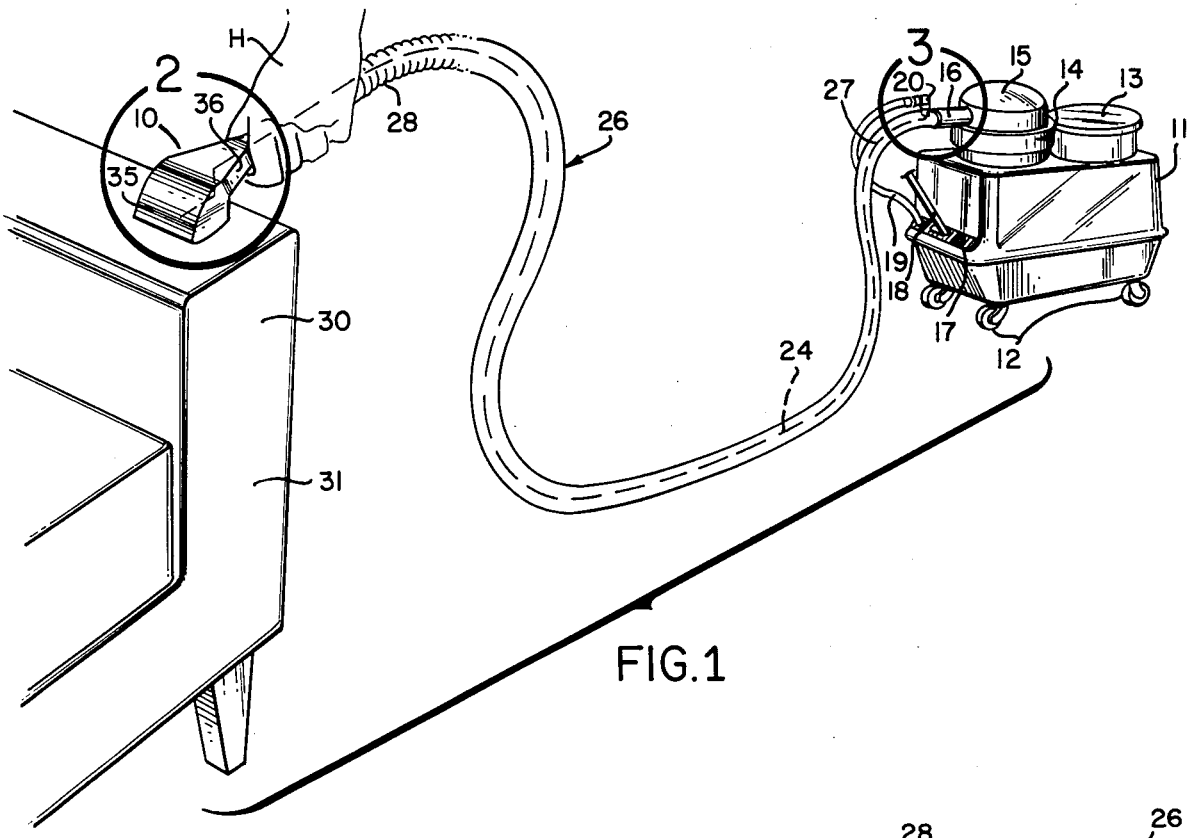
FIG. 1 is a perspective and partially schematic view showing the hand tool constructed in accordance with this invention linked to a steam cleaning machine.

Referring now to the drawings and FIG. 1 in particular, a hand tool 10 is shown being used in connection with a steam cleaning machine 11 which is easily movable from place to place on wheels 12.

The steam cleaning machine 11 includes a dispensing tank 13 which holds a special fluid solution for cleaning fabrics, carpets and the like and consists of water and various agents for cleaning, deodorizing etc. A recovery tank 14 eventually collects used fluid solution and entrained dirt, debris, etc. in a manner that shall be described. The recovery tank 14 has a lid 15 and an inlet sleeve 16. One side of the steam cleaning machine 11 is equipped with a switch and control panel 17 that may be activated when an electrical cord 18 is coupled to an electrical outlet.

A fluid solution tube 19 links dispensing tank 13 with a fluid solution exit nozzle 20 coupled to a flexible fluid solution line 24 and a flexible vacuum hose 26 in a manner that shall be more fully explained in connection with FIG. 3. Flexible vacuum hose 26 has a proximal end 27 adjacent the steam cleaning machine 11 and a distal end 28 coupled to the hand tool 10.

An operator grasping the hand tool 10 with his hand H may clean the upholstery fabric 30 of a chair, sofa or the like 31.

Figure 3:
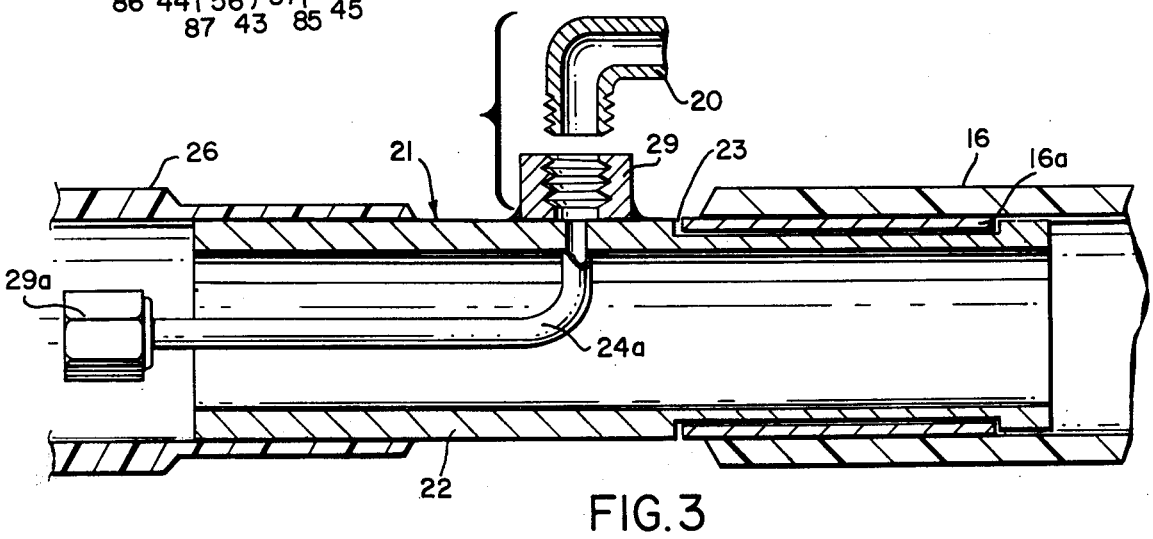
FIG. 3 is a longitudinal sectional view with some components partially exploded, showing a swivel coupling for interconnecting a flexible vacuum hose and the steam cleaning machine.

Referring now primarily to FIG. 3 the inlet collar 16 projecting from recovery tank 14 is formed internally with a stop ring 16*a*. Interposed between inlet collar 16 and the vacuum hose 26 is a swivel coupling constructed so as to facilitate maneuverability of the hand tool 10, vacuum hose 26 and fluid solution line 24 by a workman. The swivel coupling 21 includes a metal or plastic sleeve 22, one end of which is formed with an annular groove 23 sized to rotatably receive the stop ring 16*a*. Projecting laterally from one side of sleeve 22 is an inlet fitting 29 threaded to receive the fluid solution exit nozzle 20. A rigid flow line 24*a* is bent and positioned to conduct fluid solution from exit nozzle 20 to fluid solution line 24 coupled to exit fitting 29*a*. Thus, swivel coupling 21, solution line 24, and vacuum hose 26 may be twisted relative to the steam cleaning machine 11 to thereby accommodate manual movements by the workman.

Figure 2:
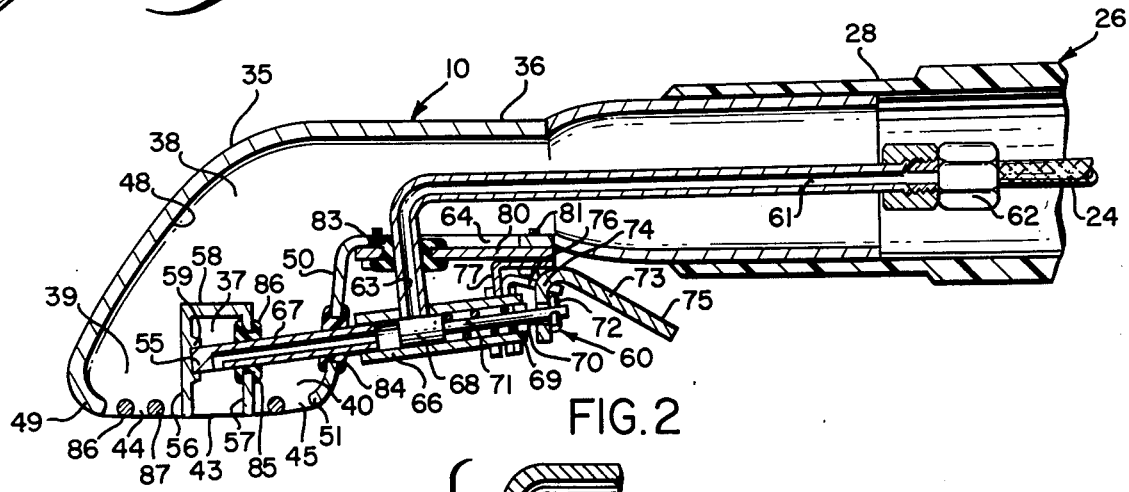
FIG. 2 is a longitudinal sectional view of a hand tool constructed in accordance with this invention, showing the relative arrangement of components within the hand tool.
Figure 5:
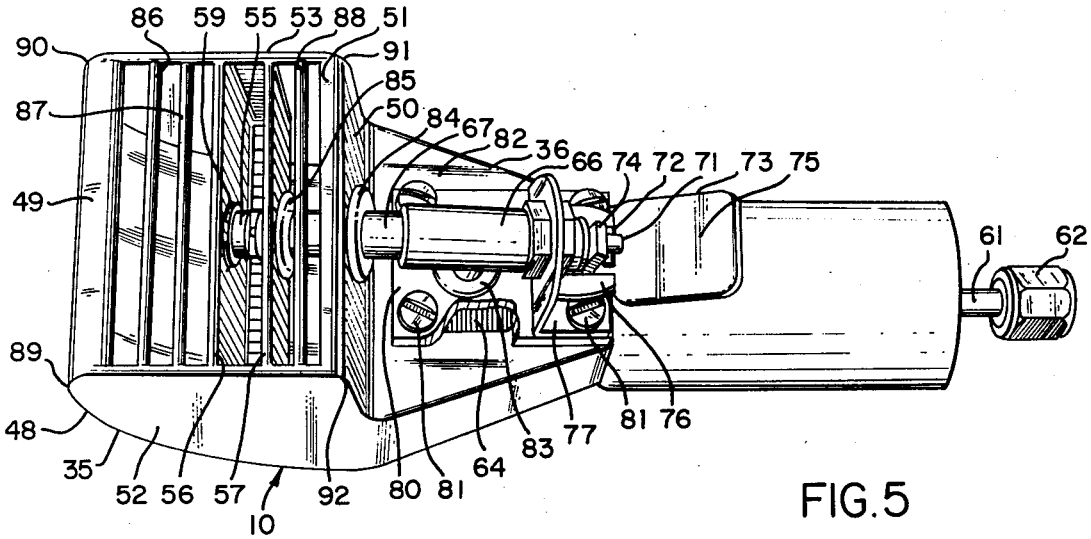

Referring now primarily to FIG. 2 and also FIG. 5 the hand tool 10 has an enlarged hollow head 35 integrally formed with a hollow neck 36. Within the hollow head 35 is a spray chamber 37 and a general suction chamber 38. In the embodiment disclosed the general suction chamber 38 is divided into a forward suction chamber 39 and a rearward suction chamber 40. A mouth portion of head 35 is constituted by three generally planar bottom openings i.e., a bottom opening 43 associated with spray chamber 37, a bottom opening 44 associated with the forward suction chamber 39 and a bottom opening 45 associated with the rear suction chamber 40.

The head 35 has a front wall 48 with a convex lower portion 49 and a rear wall 50 with a convex lower portion 51. Side walls 52 and 53 best seen in FIG. 5 connect from front wall 48 and rear wall 50. Convexly shaped lower portion 49 extends towards the rear wall 50 and convexly shaped lower portion 51 extends towards the front wall 48 to promote smooth sliding movement of the hand tool 10 over the underlying fabric. The four lower corners 89, 90, 91 and 92 defined by the head walls are also rounded to facilitate angled or misaligned movement of the hand tool 10 over fabric.

A spray nozzle 55 extends into spray chamber 37 and is defined in part by a front separator wall 56 with a rounded lower edge and a rear separator wall 57 with a rounded lower edge. The spray chamber 37 is further defined by a top separator wall 58 and adjacent portions of the head side walls 52 and 53. A seating recess 59 is formed in separator wall 56 to receive and retain spray nozzle 55.

Slung beneath hollow neck 36 and confined within a space entirely beneath hollow neck 36 is a flow control 60. A quick disconnect coupling 62 joins fluid solution line 24 and a generally rigid tubular extension 61. A distal end portion 63 of tubular extension 61 is bent so as to project laterally through an access opening 64 formed in the lower wall of hollow neck 36.

A sleeve 66 is welded or otherwise fixed to the tubular extension distal end 63 and is secured to a stem 67 which holds and/or terminates in the spray nozzle 55. A slide valve 68 is biased by a spring 69 to normally close tubular distal end 63 and prevent the flow of cleaning solution form line 24 to the spray nozzle 55. An annular stop 70 is carried by the outer end of sleeve 66 and slidably retains a valve stem 71 which carries a lateral pin 72. A manually operable trigger 73 is linked by one end 74 to the valve stem 71 and has a free end 75 which may be grasped and selectively squeezed by the operator. The trigger 75 is pivotally coupled to a stationary holder 76 which in turn is fixed to a mounting bracket 77 coupled to a relatively large mounting plate 80.

The mounting plate 80 is detachably secured to a flat under surface portion 82 of neck 36 by way of screws 81. Normally the mounting plate 80 entirely covers the access opening 64. A resilient sealing ring 83 is positioned between tubular extension 61 and mounting plate 80. A resilient sealing ring 84 is positioned between the head rear wall 50 and tube 67. A resilient sealing ring 85 is positioned between tube 67 and separator wall 57. These resilient sealing rings 83, 84 and 85 are circumferentially grooved and serve as gaskets or O-rings to prevent fluid leakage.

A special hold down means is provided in the mouth of hollow head 35 to reduce the wrinkling and ridging tendencies by the fabric as the hand tool 10 is moved over the underlying fabric. The hold down means consists of a plurality of elongated rods 86, 87 and 88 with their opposing ends connected to the head side walls 52 and 53. Preferably the rods 86, 87 and 88 are positioned to divide the suction chamber bottom openings 44 and 45 into substantially equal slots.

The rods 86, 87 and 88 together with the rounded bottom edges of separator walls 56 and 57, the convex lower portions 49 and 51 are the rounded corners 89, 90, 91 and 92 greatly facilitate the hand tool 10 in sliding back and forth across various fabrics being cleaned. The rods act as baffles by providing agitation and also facilitate cleaning by way of producing a squeegee effect.

OPERATION

To derive the numerous advantages of this invention an operator may first couple the hand tool 10 to the steam cleaning machine 11 by way of aligning and joining vacuum hose 26, the fluid solution line 24, and the swivel coupling 21. When the electro-mechanical and hydraulic systems of the steam cleaning machine 11 are ready, he may commence actually using the hand tool 10 to clean upholstery fabric 30, carpets or the like.

Figure 4:
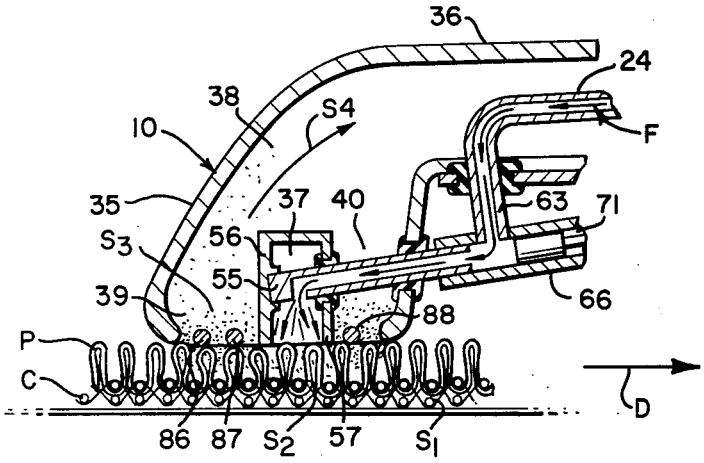
FIG. 4 is a schematic flow diagram showing the hand tool being operated to clean the underlying fabric; and, FIG. 5 is a perspective view of the bottom section of the hand tool.

When the operator squeezes trigger 75 the fluid solution is conducted from fluid solution line 24 to spray nozzle 55. Referring to the generally schematic illustration of FIG. 4, as the operator pulls hand tool 10 towards him as indicated by directional arrow D the fluid solution F travels from line 24 through spray nozzle 55 and into the pile P of the underlying carpet C. The soil and debris embedded within the pile P is loosened and suspended by the fluid solution F. The embedded soil $S_1$ is loosened and entrained within the fluid solution as indicated by $S_2$, commences to be drawn into the forward vacuum chamber 39 as indicated by $S_3$ and eventually is pulled under suction force through the general suction chamber 38 as indicated by $S_4$. The soil and debris is thereafter drawn through the vacuum hose 26 and is eventually deposited in the recovery tank 14 of the steam cleaning machine 11.

The operator may, without releasing the trigger 75, reverse the direction of travel by the hand tool 10 permitting most of the soil and debris to be drawn through the other or rear suction chamber 40. Thus the operator may maneuver the hand tool 10 back and forth, cleaning the underlying carpet or fabric during all strokes.

Since the fluid solution line 24 which is carrying relatively hot fluid solution F is concealed within and protected by the flexible vacuum hose 26, the operator is not exposed to the risk of becoming burned by contact with line 24 and the danger of harmful leakage is greatly minimized.

Because the flow control 60 is packaged completely beneath the hollow neck 36 the chances of the hand tool 10 becoming caught, snagged or otherwise obstructed are greatly minimized.

The hand tool is permitted to glide over the fabric surface when being maneuvered straight or oblique due to the convex surfaces 49 and 51, the rounded corners 89, 90 91 and 92, the rods 86, 87, and 88 and the smooth bottom edges of separator walls 56 and 57.

In order to disassemble some key components of the hand tool 10, the operator loosens nuts 81 and detaches the mounting plate 80 from neck 36. Due to the size and clearance provided by the access opening 64, the entire flow control may be shifted backwardly far enough to withdraw the spray nozzle 55 entirely out of the head 35. Thereafter the tubular extension 61 of fluid solution line 24 may be easily pulled through the access opening 64. After components have been cleaned, reconditioned and/or replaced, the flow control 60 and other components may be easily reassembled by following a reverse procedure.

From the foregoing it will be evident that the present invention has provided a hand tool in which all of the various advantages are fully realized.

What is claimed is:

1. A hand tool for cleaning fabric comprising:

(a) a generally hollow head defining a spray chamber with a bottom opening and a suction chamber with a bottom opening positioned forwardly of the spray chamber;

(b) a front wall of the head having a convexly rounded lower portion to facilitate forward movement by the hand tool over fabric;

(c) a rear wall of the head having a convexly rounded lower portion to facilitate rearward movement by the hand tool over fabric;

(d) side walls of the head between the front wall and rear wall;

(e) a hollow neck coupled to the head and arranged in communication with the suction chamber, said neck being coupled to an elongated flexible hose;

(f) a spray nozzle in the spray chamber;

(g) a fluid solution line;

(h) a flow control interconnecting the fluid solution line and spray nozzle;

(i) a steam cleaning machine having a dispensing tank for holding the fluid solution and a recovery tank, and, (j) a swivel coupling interconnecting the vacuum hose and recovery tank for facilitating maneuverability of the vacuum hose and hand tool by an operator, said swivel coupling including a collar formed internally with a stop ring; a sleeve formed with an annular groove positioned within the collar, the stop ring being positioned in the annular groove so that relative rotation can take place between said stop ring and said sleeve while holding said sleeve and said collar against axial separation;

(k) an inlet fitting connected to a side wall portion of the sleeve, for fluid communication with the dispensing tank;

(l) a rigid flow line arranged at one end in fluid communication with the inlet fitting and extending through a portion of the sleeve; and (m) an exit fitting attached to the other end of the rigid flow line, for fluid communication with the fluid solution line, wherein as the hand tool is pulled rearwardly, suction may be applied to clean areas of the underlying fabric previously sprayed.

2. A steam cleaning machine in combination with a hand tool for cleaning fabric comprising:

(a) a generally hollow head defining a spray chamber with a bottom opening, a first suction chamber with a bottom opening positioned forwardly of the spray chamber, and, a second suction chamber with a bottom opening positioned rearwardly of the spray chamber;

(b) a front wall of the head having a convexly rounded lower portion extending towards the rear wall to facilitate forward movement by the hand tool over fabric;

(c) a rear wall of the head having a convexly rounded lower portion extending towards the front wall to facilitate rearward movement by the hand tool over fabric;

(d) side walls of the head between the front wall and rear wall;

(e) a hollow neck coupled to the head and arranged in communication with the first and second suction chambers;

(f) a spray nozzle in the chamber;

(g) hold down means connected to the head and positioned within the first and second suction chamber bottom openings for reducing wrinkling and ridging tendencies by the fabric as the head is being moved over the fabric;

(h) a fluid solution line;

(i) a flow control interconnecting the fluid solution line and spray nozzle, the flow control being confined within a space entirely beneath the neck, exterior of the head and including a valve operable to cause fluid solution to pass from the fluid solution line to the spray nozzle, and, a manually operable trigger for selectively operating the valve, the neck being formed in a lower wall portion with an access opening, and, a mounting plate carrying the flow control which is detachably secured to the neck to normally cover the access opening wherein the access opening the mounting plate are relatively sized and arranged so that when the mounting plate is detached from the neck - the spray nozzle, and fluid solution line, may be withdrawn from the head and neck along with the flow control;

(j) a steam cleaning machine having a dispensing tank for holding fluid solution and a recovery tank;

(k) an elongated flexible vacuum hose releasably coupled to the neck for carrying away material drawn upwardly through the suction chamber, the fluid solution line being surrounded by the flexible vacuum hose with the fluid solution line projecting laterally through the neck and into connection with the flow control;

(l) a swivel coupling interconnecting the vacuum hose and recovery tank, facilitating maneuverability of the hand tool and vacuum hose by an operator, said swivel coupling including a collar formed internally with a stop ring; a sleeve formed with an annular groove positioned within the collar, the stop ring being positioned in the annular groove so that relative rotation can take place between said stop ring and said sleeve while holding said sleeve and said collar against axial separation;

(m) an inlet fitting connected to a side wall portion of the sleeve, for fluid communication with the dispensing tank;

(n) a rigid flow line arranged at one end in fluid communication with the inlet fitting and extending through a portion of the sleeve; and (o) an exit fitting attached to the other end of the flow line, for fluid communication with the fluid solution line, wherein suction may be continuously applied to sprayed areas of the underlying fabric as the hand tool is alternately pushed forward and pulled rearwardly.

* * * * *